United States Patent [19]

Schmanski

[11] 4,249,832

[45] Feb. 10, 1981

[54] HIGHWAY MEDIAN DELINEATOR

[75] Inventor: Donald W. Schmanski, Carson City, Nev.

[73] Assignee: High Performance Composites, Inc., Carson City, Nev.

[21] Appl. No.: 969,083

[22] Filed: Dec. 13, 1978

[51] Int. Cl.[3] ..... E01F 15/00

[52] U.S. Cl. ..... 404/6; 404/9; 404/10; 40/606; 256/13.1

[58] Field of Search ..... 404/6, 10, 9; 256/13.1; 40/606-612; 240/72; 116/63 R

[56] References Cited

U.S. PATENT DOCUMENTS

| | | | |
|---|---|---|---|
| 1,238,387 | 8/1917 | Buck | 40/607 X |
| 2,064,519 | 12/1936 | Casey | 404/6 |
| 2,193,747 | 3/1940 | Thompson | 40/607 X |
| 3,114,303 | 12/1963 | Oberbach | 404/6 X |
| 3,370,369 | 2/1968 | Look | 40/607 |
| 3,591,144 | 7/1971 | Iving | 404/10 X |
| 3,847,497 | 11/1974 | Guillory | 404/10 |
| 3,863,595 | 2/1975 | Barnett | 404/10 X |
| 3,882,618 | 5/1975 | Hart | 40/609 |
| 3,922,805 | 12/1975 | Krug | 40/606 |
| 4,092,081 | 5/1978 | Schmanski | 404/10 |

FOREIGN PATENT DOCUMENTS 482872 1/1970 Switzerland .

*Primary Examiner*—Nile C. Byers, Jr.
*Attorney, Agent, or Firm*—Thorpe, North, Western & Gold

[57] ABSTRACT

Flexible elongate web structures with reflective faces are fixed on opposing ends of a support arm which is centrally mounted over a highway barrier. Appropriate geometric structure and material selection provide a non-destructive bending response for the respective web structures during vehicle impact and provide for restoration to original orientation. The support or mounting arm is formed of polymer material having sufficient rigidity to support the web structure during static conditions and sufficient compliance and flexibility to bend and twist during the vehicle impact.

9 Claims, 2 Drawing Figures

HIGHWAY MEDIAN DELINEATOR

BACKGROUND OF THE INVENTION

1. Field of the Invention

This invention relates to highway delineation, with particular reference to delineation for median barriers which seperate opposing sides of a divided highway.

2. Prior Art

The use of a median barrier between opposing directions of a divided highway provides numerous advantages of safety and traffic regulation. A common form of median barrier is indicated in FIG. 1 and is known to those skilled in the art as a New Jersey-type barricade or barrier. Although plainly visible during daylight hours, the barricade becomes deceptively ill-defined during nighttime driving, particularly where visibility is further hampered by poor weather conditions. It is not uncommon, therefore, to observe tire impact lines along the barrier sidewall, witnessing to a previous lack of perception or misjudgment by a vehicle driver.

To assist driver recognition of such median barriers during poor visibility, techniques of highway delineation have been applied to the barrier structure. The most common method of barrier identification has been to apply reflective buttons 10 (FIG. 1) at the sidewall surface of the barrier such that vehicle headlights are reflected to warn the driver of the barrier location. Such reflective buttons are usually several inches in height and may include a prismatic reflecting means to distribute light through multiple angles of observation, or retro reflective materials to return the light to its original source. Numerous difficulties remain with the use of such reflective buttons and similar barrier delineation techniques, resulting in continued injuries to life and property, in addition to maintenance costs associated with repair and reconstruction of impacted median barriers.

The types of safety problems arising from the use of such delineation techniques include inadequate identification as to the nature of what object is being delineated. For example, when such a reflective button is viewed at a distance during the night it is difficult for a driver to ascertain whether such a reflective button is located on a bicycle, roadside post or median barrier. Obviously, driver reaction will be different with respect to each form of obstacle encountered. This confusion is enhanced when headlights from an oncoming vehicle traveling on the opposite side of the median barrier give a deceptive appearance as a reflector as opposed to a headlight. Such deception is particularly accute where the top or cap of the median barrier is also delineated with reflective buttons, since such barriers are purposely constructed so that headlights from the opposing traffic can be viewed just over the barrier top.

In addition to difficulty in resolution, depth perception of the delineated object is not provided from the reflector type buttons affixed on sidewalls of the median barrier. Such depth perception is invaluable to a driver who is about to negotiate a curve in the road, where rate of curvature is not clearly indicated by mere reflection from an almost point reflective source. Lack of ability to adjust speed because of absence of depth perception is frequently the cause for direct impact at the median barrier wall.

Other problems encountered with current delineation methods include effects of weather in concealing the small reflective buttons at the barrier sidewall. The small reflective surface is quickly concealed by splashed mud, debris, etc. which voids any reflective ability. Furthermore, impact at the reflector by overhanging structure of a truck or vehicle will typically destroy these reflective buttons, resulting in loss of delineation and increased risk to drivers, as well as additional cost for replacement and maintenance. This partial description of safety hazards associated with current delineation techniques suggests the need for a novel approach to median barrier delineation.

OBJECTS AND SUMMARY OF THE INVENTION

It is an object of the present invention to provide improved methods for delineation of a highway median barrier.

It is an additional object of this invention to provide such delineation with materials which can survive physical impact and still remain functional.

It is an additional object of this invention to provide delineation structure which is inexpensive to install and maintain.

A further object of this invention is to incorporate structural and material response within the delineator to improve non-destructive response during impact.

These and other objects are realized in a highway median barrier delineator which consists of an elongate web having a geometric structure which deforms upon impact to develop a non-destructive bending response, with physical restoration to its approximate original orientation. This web is supported by a mounting arm which is attached across the web length and extends laterally therefrom to enable positioning of the web away from the sidewall of the median barrier such that the web is free to contort about the mounting arm during dynamic conditions subsequent to impact. The arm is likewise responsive to impact, being constructed of materials having sufficient rigidity to support the web during static conditions, but sufficient torsional compliance and flexibility to bend and twist during the stated dynamic conditions. Such material selection and physical configuration for the arm preferably develop a structural preference for twisting motion, as opposed to bending motion at the longitudinal axis thereof. When a pair of web structures are attached at the top of the median barrier in a saddle-like configuration, improved angularity is developed. With such web configuration, the respective convex surfaces of each web will be directed toward the oncoming traffic and will therefore be mounted in opposing directions with respect to the support arm.

These and other features will be more apparant to those skilled in the art from the following detailed description, taken in combination with the appended drawings.

DETAILED DESCRIPTION OF THE DRAWINGS

DETAILED DESCRIPTION OF THE INVENTION

Figure 1:
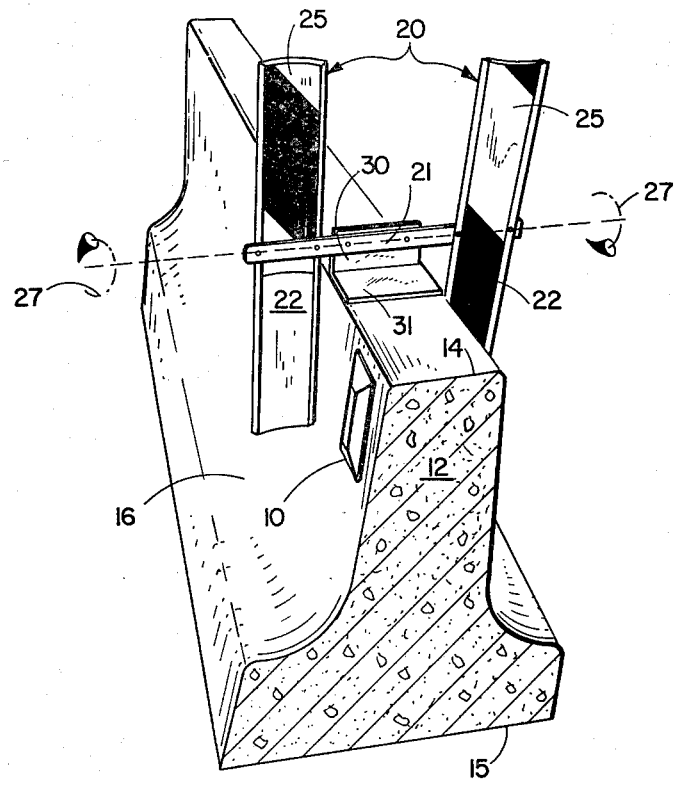
FIG. 1 depicts a perspective view of a median barrier delineator, shown in combination with a conventional reflector button.

Referring now to the drawings:

A roadway barrier 12 is illustrated after the format of the New Jersey-type barrier which divides opposing directions of a typical highway 13. The referenced New Jersey-type barrier has approximate dimensions of a 6" top 14 and a 24" base 15, with an approximate 31" height. Material construction consists of concrete to give sufficient strength to resist vehicle impact and thereby reduce the possibility of headon collision between the opposing lanes of traffic.

A preferred delineator for barricades similar in the form to the New Jersey-type barricade comprises a pair of delineator web structures 20 mounted on a support arm 21 which in turn is mounted at the top 14 of the median barrier 12.

Each delineator web structure 20 is formed from an elongate web 22 having a geometric structure and/or material composition which permit deformation upon impact by a moving object to thereby develop a non-destructive bending response within the delineator web structure. Ideally, such geometric and/or material composition will provide sufficient resiliency to cause restoration of the subject web structure 20 to its original orientation.

Numerous types of materials are available which meet the mechanical requirements to provide the stated non-destructive bending response. U.S. Pat. No. 4,092,081 describes various fiber supported resin composites which utilize geometric configuration and/or various combinations of material composition to obtain flexibility in an otherwise rigid structure. One such structure for the elongate web 22 comprises a fiberglass/resin composite which is molded or pultruded in the form of a concavo-convex geometric configuration as illustrated in the figures. Such geometric configuration in a web having an approximate thickness of $\frac{1}{4}$" enables a decrease in moment of inertia of the web structure during bending movement caused from impact from a moving vehicle. Such bending movement permits the delineator web structure 20 to contort and thereby dissipate the referenced impact force without destroying the future utility for the impacted delineator.

As illustrated in the reference U.S. patent, numerous configurations and/or combinations of materials can be developed to produce the desired flexibility. The concavo-convex structure has an additional preference of providing improved angularity for observation by an approaching driver at various observation or divergence angles. As used herein, divergence angle means the angle between the line formed by a light beam striking a delineator surface or reflector and the line formed by its reflective beam. This is also called the observation angle since the line formed by the reflected beam is in fact the light observed by the driver. The importance of good angularity arises from the fact that a driver's approach toward a reflecting delineator surface will pass through a range of divergence angles as he traverses a curved portion of the highway. Because the incident light from the driver's headlights strikes successive parts of a curved surface of the convex delineator, reflection through a broad range of divergent angles is accomplished. Likewise the concave side offers similar improved angularity over a flat reflective surface.

Figure 2:
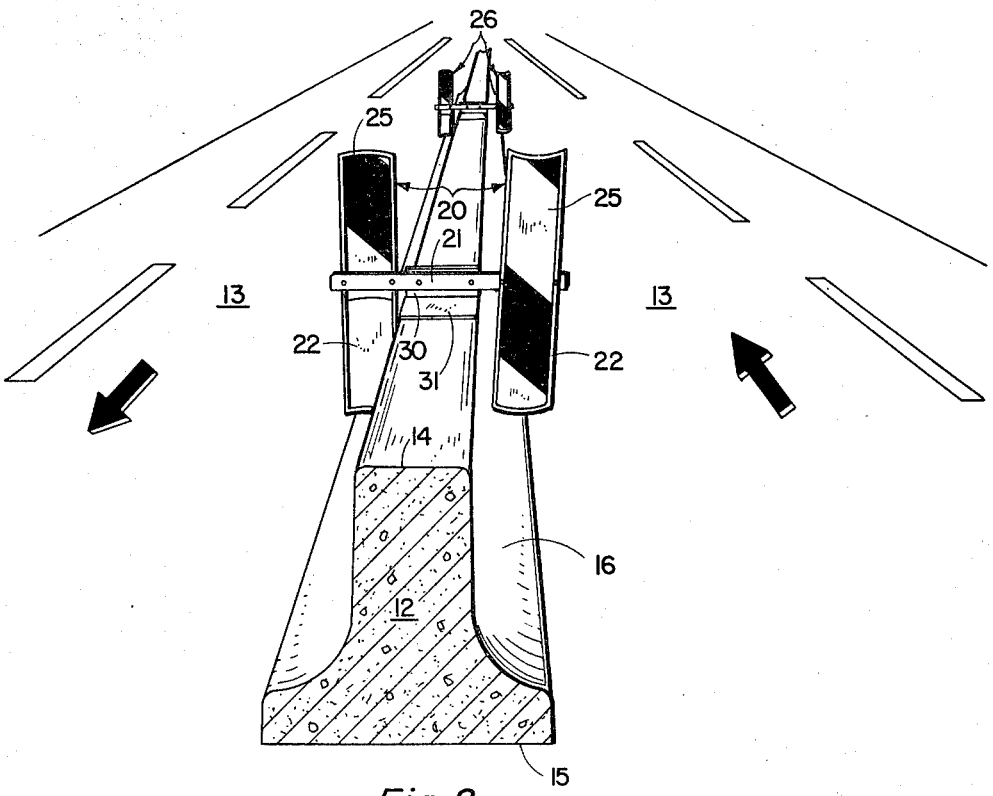
FIG. 2 shows a direct perspective view along a median barrier having several delineator devices mounted thereon.

In the embodiment represented in FIGS. 1 and 2, the web structures 20 are mounted on the support arm 21 such that the convex face of the concavo-convex structure is exposed toward the direction of oncoming traffic. Reflective material 25 is attached along the full length of the convex side and along the concave side extending from the top of the delineator down to a mid-section of the delineator aligned with the top of the barricade 14. The preferred reflective material may provide retro reflection by incorporating spherical or cube corner reflector means. Such reflective material is commercially available and need not be further explicated.

An exemplary set of dimensions for the web structure would include a length of approximately 28" and width of approximately 4". Obviously, the variation of length and width to conform to a variety of barrier applications is envisioned. Regulating state or federal agencies may also establish length and width dimension to insure safety and uniformity.

The pair of delineator web structures 20 are riveted or otherwise attached at opposing ends of the support arm 21. This support arm should be of sufficient length to displace each of the respective web structures away from the side wall 16 so that bending motion of the delineator is not obstructed. Such displacement should be no more than necessary to avoid contact with the sidewall inasmuch as increased distance from the barrier increases the probability of impact from moving traffic. As illustrated in the figures, the flanged base of the barrier provides some protection in that the base 15 extends beyond the extreme sides of the delineator structure.

The delineator structure 20 is mounted in upright orientation such that the longitudinal delineator axis is substantially parallel to the upright axis of the median barrier. Such orientation is particularly useful in providing depth perception along a length of highway. As illustrated in FIG. 2, depth perception is realized because of the substantial length of the barrier delineator in comparison to the button reflector 10 previously used. This elongate structure not only provides basis for estimation of distances between the first delineator structure 20 and the remote delineator structure 26, but the obtrusive size of the subject delineators tends to exaggerate the risk of vehicle contact and therefore discourages high speed or recklessness. This is particularly true at night where the only visible form at a distance is the actual reflective material on the webbed structure. The elongate height and bold reflection from such structures tends to intimidate drivers away from possible contact therewith. Experimental testing has shown that such intimidation has the direct consequence of causing drivers to decrease their speed and increase their attention increase their attention with respect to the potential risks being accentuated. This, of course, is the primary function of highway delineation.

It can be visualized, for example, that a curve in the highway properly delineated by the elongate web structure illustrated in the figures would tend to reflect as a solid wall structure tapering in perspective toward the direction of travel for the attentive driver. Confusion with headlights and other apparent spot-like sources of light emission is also unlikely in view of the elongate reflective surface used in conjunction with the subject delineator.

In addition to the novelty and utility of the elongate web structure previously discussed, a significant aspect of the subject invention involves the mechanical operation of the mounting arm with respect to the web structure during impact. Like the web structure, the mounting arm 21 should be impact resistant so that impact forces can be dissipated by the contortion of the arm after impact. It will be apparent from the figures that impact at a midsection of the delineator will tend to bend the mounting arm in a direction common with the direction of travel for the moving object. Therefore, the material composition and geometric structure for this mounting arm 21 must incorporate the mechanical compliance to permit such bending motion without destruction of the mounting arm structure.

Normally, impact by a moving object will occur at a contact point off center with respect to the longitudinal access 27 of the mounting arm. This leads to a torsional response which is significant because it tends to whip the delineator in a contorting action which rapidly dissipates the force to avoid destruction of the web structure and mounting arm.

In view of the greater capacity of the subject delineator to dissipate impact energy through rotational contortion of the web structure, the preferred delineator embodiment utilizes a mounting arm 21 which has a preference toward torsional motion as opposed to bending motion along its longitudinal axis 27. Such a preference to torsional response can be developed by material selection and composition and/or geometric structure. In resin/fiberglass composites, the longitudinal arrangement of fibers tends to develop longitudinal rigidity which increases longitudinal rigidity, while retaining sufficient torsional compliance to favor rotational motion versus bending motion along the subject longitudinal axis 27.

Such rotational compliance can also be enhanced by geometric configuration of the mounting arm. A strap or rod, having a single rotational axis, readily develops a preference for torsional motion. Any form of structure which develops substantial nonlinearity in the subject longitudinal axis 27 would tend to inhibit rotational motion, making the delineator more subject to destructive consequences of impact.

The elongate, flat structure shown in the figure for the mounting arm 21 incorporates this preference for rotational motion as opposed to bending motion, and also develops sufficient rigidity to maintain the delineator structures in upright orientation during static conditions in which impact forces are not present. Such ploymers as LEXAN (trademark), as well as numerous glass reinforced composites, are well suited with the desirable impact resistance and torsional compliance to function effectively as a mounting arm. The illustrated embodiment of the figures utilizes such a strap of reinforced composite having a length of 24" and an approximate thickness of 0.2".

The mounting arm with attached web structures is fixed at a top portion of the median barrier by any means which will permanently withstand impact forces transferred thereto from the delineator web structure. One such means for attachment comprises a right-angle support fixed at one leg 30 to a central position on the mounting arm, with a second right-angle leg 31 being adapted for attachment at the top surface 14 of the median barrier 12. The mounting arm 21 can be riveted to the first right-angle leg 30, with the second right-angle leg 31 being attached at the barrier by means of studs, epoxy glue or similar permanent adhesive means. It will be obvious to those skilled in the art that the means for attachment can be accomplished by many methods, the illustrated method simply being exemplary of a means which provides permanent fixation of the delineator at the median barrier.

The advantages arising from utilization of the improved delineator device discussed herein include substantial cost savings in maintance and material replacement. Tests have shown that the subject delineator can withstand repeated impacts by vehicles traveling at normal speeds, with subsequent restoration of the delineator to its original orientation. In addition to cost savings, the effectiveness of the subject barrier in discouraging driver carelessness represents a substantial improvement over the prior art. Tests have shown that conversion of the conventional button reflector system to the subject elongate delineator system has reduced the frequency of barrier impacts from daily to monthly or better. Such improvement is undoubtly the result of substantially improved depth perception caused by the elongate web structure, as well as the increased intimidation which results from the broad reflective surface.

In addition, the subject invention provides delineation above the median barrier, as opposed to the limited delineation provided by the reflective buttons. Confusion between delineator or reflectors and light emission sources (such as opposing vehicle headlights) is minimized because of the clear resolution between shapes. This resolution is enhanced by virtue of the improved angularity developed by the concavo-convex reflective surfaces incorporated in the subject delineators.

In addition to these mechanical features, the subject delineator is substantially more servicable under normal conditions because of the greater surface area which extends above the splash area of the sidewall of the barrier. During poor weather conditions, heavy traffic will tend to coat the barrier sidewalls 16 with mud and debris, thereby obscuring the reflective surface and voiding any effect of delineation. The orientation and increased surface area of the subject delineator provide tolerance for such poor weather splash conditions.

Although preferred forms of the invention have been described herein, it is to be understood that variations from the present disclosure are possible and will be obvious to those skilled in the art. For example, although the disclosed delineator provides the economic benefit of being able to attach two delineators in a single installation, a single delineator web structure could likewise be mounted at the median barrier as equivalent structure. In this case, the laterally extending support arm could be attached below the barrier top or at sidewalls under bridges or in tunnels where highway delineation is needed. It is therefore to be expressly understood that the subject disclosure is not be way of limitation, and that the invention is to be identified only from the following claims.

I claim:

1. A median barrier delineator comprising:

a. a pair of elongate webs, each having a geometric structure which deforms upon impact by a moving object to develop a nondestructive bending response, with subsequent restoration to its approximate original orientation and configuration;

b. an elongate mounting arm attached at each end thereof to one of the elongate webs such that the mounting arm supports the elongate web pair in an upright orientation, and has sufficient length such that the attached webs are displaced a sufficient distance away from the median barrier to permit the web to freely contort about the mounting arm upon occurrence of said impact by the moving object, said arm being comprised of materials having sufficient rigidity to support said web pair during static conditions, but sufficient contortional compliance and flexibility to bend and twist during dynamic conditions resulting from the impact; and c. attachment means disposed centrally along the mounting arm for coupling the arm with mounted webs across said median barrier in an upright orientation with respect to sidewalls of the median barrier.

2. A delineator as defined in claim 1 wherein material selection or geometric structure of the mounting arm develops a preference for tortional motion as opposed to bending motion at its longitudinal axis.

3. A delineator as defined in claim 1, wherein said web includes forward and rearward faces for carrying reflective material.

4. A delineator as defined in claim 1, wherein said web comprises a concavo-convex forward/rearward face structure to provide a broad range of observation angularity.

5. A delineator as defined in claim 1, wherein said arm is mounted centrally across a midsection of each elongate web length.

6. A delineator as defined in claim 1, wherein said webs are adapted for mounting in substantial parallel orientation.

7. A delineator as defined in claim 1, wherein said arm comprises a flat length of flexible polymer material having the required torsional compliance and flexibility with respect to said webs, said delineator having attachment means comprising a right-angle support fixed at one leg to a central position on said arm and a second right-angle leg being adapted for attachment at a top surface of said median barrier.

8. A delineator as defined in claim 1 or 7, wherein said arm is constructed of a strap of glass reinforced composite.

9. A delineator as defined in claim 7, wherein said second right-angle leg is adapted for bonding to a New Jersey-type median barrier, with the attached arm and webs extending in upright orientation with respect thereto.

* * * * *